US011148023B2

(12) United States Patent
Roiser

(10) Patent No.: US 11,148,023 B2
(45) Date of Patent: Oct. 19, 2021

(54) FOLDABLE STICK, IN PARTICULAR A SPORTS STICK

(71) Applicant: Komperdell Sportartikel Ges.m.b.H., Mondsee (AT)

(72) Inventor: Thomas Roiser, Mondsee (AT)

(73) Assignee: KOMPERDELL SPORTARTIKEL GES.M.B.H., Mondsee (AT)

( * ) Notice: Subject to any disclaimer, the term of this patent is extended or adjusted under 35 U.S.C. 154(b) by 0 days.

(21) Appl. No.: 16/709,473

(22) Filed: Dec. 10, 2019

(65) Prior Publication Data

US 2020/0179776 A1 Jun. 11, 2020

(30) Foreign Application Priority Data

Dec. 10, 2018 (DE) ..... 10 2018 221 307.0

(51) Int. Cl.
*A63B 60/06* (2015.01)
*A45B 9/00* (2006.01)

(52) U.S. Cl.
CPC ..... *A63B 60/06* (2015.10); *A63B 2210/50* (2013.01)

(58) Field of Classification Search
CPC ..... E04H 15/60; A63C 11/22; A45B 9/00; A45B 2009/005
USPC ..... 135/72
See application file for complete search history.

(56) References Cited

U.S. PATENT DOCUMENTS 111,453 A * 1/1871 Hirsch ..... A45B 17/00 135/74
888,468 A * 5/1908 Casale ..... A45B 19/06 135/26
2,133,717 A 10/1938 Robes, Jr.
2,705,015 A * 3/1955 Langlais ..... A45B 9/00 52/632
3,448,748 A * 6/1969 Walrave ..... E04H 15/30 135/127
RE28,067 E * 7/1974 Hyman ..... A45B 7/00 135/74

(Continued)

FOREIGN PATENT DOCUMENTS

AT 15670 B 3/1904
AT 15670 U1 4/2018

(Continued)

OTHER PUBLICATIONS

German Application No. 10 2018 221 307.0, German Search Report dated Nov. 21, 2019, 8 pages.

(Continued)

*Primary Examiner* — Noah Chandler Hawk
(74) *Attorney, Agent, or Firm* — Kilpatrick Townsend & Stockton LLP

(57) ABSTRACT

The present invention provides a foldable stick (10), in particular a sports stick (10). The foldable stick (1) includes a plurality of stick segments (12, 14, 16) and at least one tensioning mechanism (18, 20). The stick (10) is adjustable between an assembled configuration in which all stick segments (12, 14, 16) are joined aligned axially with one another, and a disassembled configuration in which the stick segments (12, 14, 16) are detached from one another and can be folded together. The tensioning mechanism (18, 20) is adapted to pretension the stick segments (12, 14, 16) into the assembled configuration of the stick (10).

17 Claims, 5 Drawing Sheets

(56) References Cited

U.S. PATENT DOCUMENTS

Figure 1:
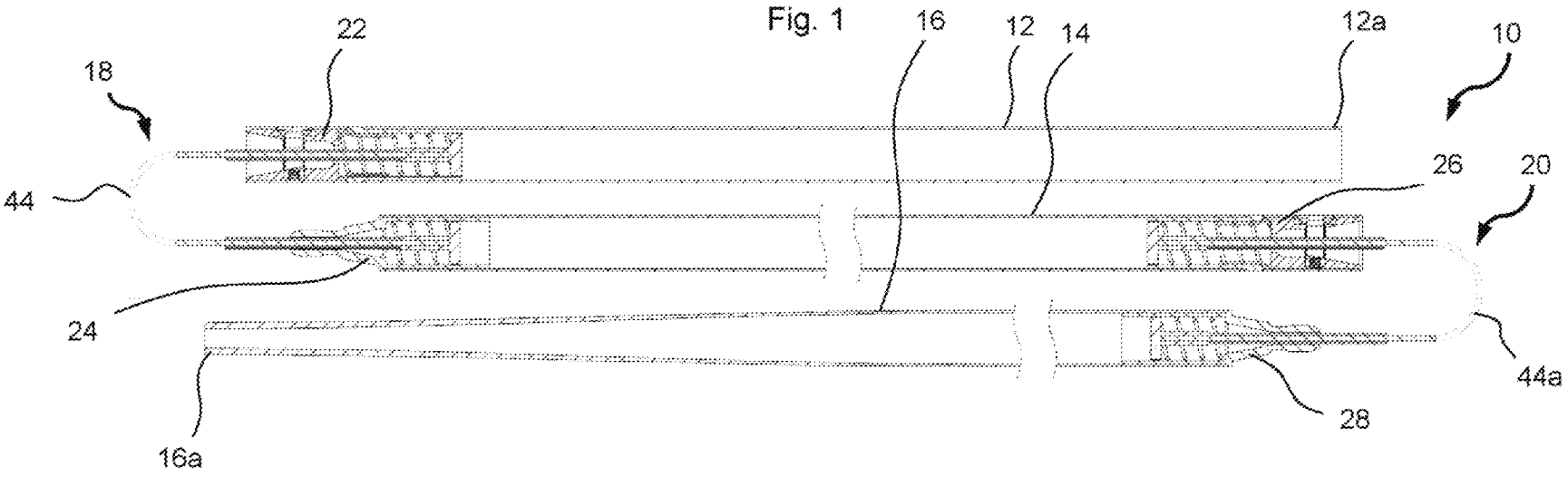

| | | | | | |
|---|---|---|---|---|---|
| 4,869,280 | A * | 9/1989 | Ewing | A61H 3/02 | 135/69 |
| 5,029,847 | A * | 7/1991 | Ross | A63B 15/00 | 135/114 |
| 7,434,592 | B2 * | 10/2008 | Larson | A61H 3/02 | 135/72 |
| 7,841,353 | B2 * | 11/2010 | Lee | A45B 9/00 | 135/74 |
| 8,657,351 | B2 * | 2/2014 | Johnson | A63F 9/0001 | 294/19.2 |
| 8,950,415 | B1 * | 2/2015 | Spletzer | A61H 3/02 | 135/74 |
| 2002/0067866 | A1 | 6/2002 | Moor et al. | | |
| 2013/0312797 | A1 * | 11/2013 | Lah | A45B 19/08 | 135/74 |
| 2017/0027290 | A1 * | 2/2017 | Heim | A63C 11/22 | |
| 2017/0127775 | A1 * | 5/2017 | Lenhart | A63C 11/221 | |
| 2020/0008545 | A1 * | 1/2020 | Strum | A45B 9/02 | |

FOREIGN PATENT DOCUMENTS

| | | | | |
|---|---|---|---|---|
| CN | 104188443 | A | 12/2014 | |
| CN | 205216103 | U | 5/2016 | |
| DE | 10215593 | A1 * | 10/2003 | A63C 11/22 |
| DE | 10215593 | A1 | 10/2003 | |
| DE | 20211381 | U1 | 12/2003 | |
| DE | 102012104633 | A1 | 12/2013 | |
| EP | 1277419 | A1 | 1/2003 | |
| GB | 932882 | A | 7/1963 | |
| JP | 55431 | U | 1/1980 | |
| JP | 2007209418 | A | 8/2007 | |
| JP | 2011163056 | A | 8/2011 | |
| JP | 20100029357 | | 9/2013 | |

OTHER PUBLICATIONS

European Patent Application No. EP19214861.7, European Search Report dated Apr. 30, 2020, 6 pages.

* cited by examiner

FOLDABLE STICK, IN PARTICULAR A SPORTS STICK

CROSS REFERENCE TO RELATED APPLICATION

This application claims priority to German Patent Application No. 10 2018 221 307.0, filed in Germany on Dec. 10, 2018, the entire contents of which are hereby incorporated herein by this reference.

The present invention relates to a foldable stick, in particular a sports stick, comprising a plurality of stick segments and at least one tensioning mechanism, the stick being adjustable between an assembled configuration in which all stick segments are joined aligned axially with one another and a disassembled configuration in which the stick segments are detached from one another and can be folded together.

In the prior art, for example, foldable sticks are known, which consist of several stick segments. These stick segments are held together by a in most cases flexibly designed, continuous connecting cable which runs inside the stick segments and is fastened, for example, to a handle-side end section of the stick and to a tip-side end section of the stick. Usually, two stick segments are designed telescopically to each other, so that when one of these stick segments is pulled out of the other, the connecting cable is tensioned and thus axially aligns the remaining stick segments and presses them against one another with their end sections. This pulling out usually overcomes a locking mechanism that locks the stick segments together.

Disadvantages of such known sticks are, in particular, that a user has to assemble the individual stick segments, for example, by tensioning the connecting cable, and in some cases has to bring the locking mechanism into a locked position with a not inconsiderable amount of force in order to align and fix the stick segments axially to one another. Ease of use for a user is therefore in need of improvement in such known foldable sticks. Also, the connecting cable used, which is usually designed to be flexible, is constantly subjected to a certain tensile force in these known sticks in an assembled state of the stick segments in order to hold the stick segments together, which can lead to fatigue of the pull cable and thus to a shortened durability of the stick. In addition, such known sticks are usually locked only at a junction between two stick segments. Accordingly, the remaining stick segments are held together only by the connecting cable under tension, which can have a negative effect on the stability of these known sticks.

Against this background, it is an object of the present invention to provide a foldable stick, in particular a sports stick, with better ease of use and also to ensure a long durability and high stability of the stick, in particular of junctions of stick segments.

The object of the invention formulated above is achieved by a foldable stick, in particular a sports stick, comprising a plurality of stick segments and at least one tensioning mechanism, the stick being adjustable between an assembled configuration in which all stick segments are joined axially aligned with one another and a disassembled configuration in which the stick segments are detached from one another and can be folded together, and wherein the tensioning mechanism is adapted to pretension the stick segments into the assembled configuration of the stick.

The fact that the tensioning mechanism also pretensions the stick segments in the disassembled configuration into the assembled configuration of the stick, considerably improves operation of the stick and ease of use, since a user does not have to bring the stick segments into the correct position in order to be able to join them together, but possibly only can join together the already positioned stick segments with little effort, without having to be particularly precise.

In particular, it may be provided that a tensioning mechanism is provided between each of two stick segments at one end section of a stick segment and at a complementary end section of an adjacent stick segment. Thus, the at least one tensioning mechanism can even in the disassembled configuration hold adjacent stick segments together detached from and moveable to one another under an external force, so that the stick segments cannot be folded together in an axially aligned manner, but remain connected to one another in a spaced apart manner by the tensioning mechanism.

The tensioning mechanism may particularly preferably be adapted to pretension the stick segments into the assembled configuration of the stick such that they are self-unfoldable into the assembled configuration of the stick without any external force being exerted. The at least one tensioning mechanism may in particular be designed such that its spring force is sufficient to bring the stick segments into the assembled configuration of the stick. Through a self-unfoldable adjustment of the stick segments brought about by the tensioning mechanism into the assembled configuration of the stick, a user of the stick can be offered maximum ease of use, since the user only has to remove an external force acting on the stick segments, such as a band wrapped around the segments, which holds the stick segments in the disassembled configuration of the stick, in order to adjust all stick segments of the stick into the assembled configuration. A user of the stick according to the invention thus very easily and extremely quickly obtains a stick which can be used. An external force means, for example, a fixation of the stick segments parallel to each other in order to be able to stow the foldable stick with a smaller pack size. Such a fixation can be achieved, for example, by a band to be wrapped around the stick segments, for example, with a Velcro fastener, or by other fixation options, such as a string or the like to be tied around it.

In one embodiment of the present invention, the stick may further comprise a handle provided on a handle-side upper end of the stick at an uppermost stick segment and a tip provided on a tip-side lower end of the stick opposite the handle-side end on a lowermost stick segment. Such a stick having a handle for securely holding the stick and a tip for a good grip on any surface can also offer good ease of use.

In particular, the lowermost stick segment can be tapered in the direction of the tip. A tapering of the tip-side lowermost stick segment is, on the one hand, favourable for fastening a tip and a stick plate that is mostly used, which has an opening with a usually smaller diameter than the diameter of the other stick segments. The stick plate may also be pushed from the tip section with the opening to the lowermost stick segment and clamped at a predetermined position of the stick segment having an identical or slightly larger diameter than that of the stick plate opening. In addition, a stick having a tapered tip-side stick segment has a more successful external appearance in terms of design than sticks having a constant diameter over the entire length.

In a further preferred embodiment of the invention, each tensioning mechanism may comprise a locking mechanism which is adapted to block two adjacent stick segments from one another axially, preferably axially and radially, in the assembled configuration of the stick. In particular when the tensioning mechanism causes the, in particular self-unfoldable, adjustment of the stick segments into the assembled configuration of the stick, the locking mechanism can automatically axially, preferably also radially, block the two adjacent stick segments. The spring force of the tensioning mechanism may in particular be designed such that it is sufficient to overcome the total resistance of the connection arrangement of two stick segments in order to pretension the stick segments into the assembled configuration of the stick, in particular to self-unfoldably adjust said stick segments into the assembled configuration of the stick without external force. This total resistance may be composed, inter alia, of the frictional resistance which arises when the stick segments are joined together, in particular at the end sections, and the resistance of the locking mechanism to be overcome. If more than two stick segments are provided, the stability of the stick can be improved in that a locking mechanism may be provided at each junction between two adjacent stick segments.

In this embodiment, the locking mechanism may particularly preferably be provided in the form of a spring-loaded push button, the push button being adapted to release the locking of the adjacent stick segments when the push button is actuated, preferably in the radial direction. In this way, a very simple operation of the stick can in turn be ensured by simply pressing the push button in order to be able to adjust the stick segments from the assembled configuration to the disassembled configuration. Instead of a push button, another locking mechanism such as a clamp or the like may also be used to block the stick segments against one another.

In particular, each stick segment of the plurality of stick segments may also have essentially the same length. One advantage of an essentially identical length of the stick segments is that the smallest possible pack size can be achieved in this way in the disassembled configuration. In addition, using same parts facilitates production in terms of costs, etc.

In yet another advantageous embodiment of the present invention, each tensioning mechanism may further comprise a tension element in the form of a cable, the end sections of the stick segments each having a continuous axial channel for guiding the cable and the cable running through the guide channels of the end sections. In this way, the cable can hold the stick segments together even in the disassembled configuration.

A cable may preferably be provided for each tensioning mechanism, which extends essentially over the length of the tensioning mechanism and is not designed to run over the entire length of the stick and is preferably shorter than a stick segment. Alternatively, the cable may also be designed to be essentially continuous over the entire length of the stick, for example for manufacturing reasons or to connect the stick segments to one another in the disassembled state. However, it is considered to be more advantageous if the cable is not designed to be continuous, since due to only one cable being provided for each tensioning mechanism, which merely holds the stick segments together in the disassembled configuration and not being used for bracing the stick segments towards one another, in particular the durability or service life of the stick can be increased.

In addition, it is to be regarded as advantageous if the tension element is essentially not elastically flexible. In this case, an elastic pretension is not achieved by the tension element, but by at least one other elastic element of the tensioning mechanism, such as springs, which withstand a permanent load better in the assembled configuration of the stick than, for example, a cable as tension element, which would loose tensile force and expand over a period of time, which may lead to the stick segments being held in the assembled configuration with a weaker tensile force after the stick has been used for a certain time. In this way, the durability of the stick can be increased again. As an alternative, the tension element may also be designed to be elastically flexible, should an additional elastic element for the tensioning mechanism be dispensed with in order to be able to reduce the number of components. However, the variant having a non-elastically flexible tension element is preferred in order, as explained above, to avoid material fatigue and to be able to increase the service life.

The tensioning mechanism may preferably act like a tension spring mechanism, with a first end of the tension spring mechanism being fastened to an end section of a stick segment and a second end of the tension spring mechanism being fastened to a complementary end section of an adjacent stick segment. Such an arrangement and design of the tensioning mechanism may provide increased ease of use by virtue of the fact that the stick segments can remain connected in that they are pretensioned into the assembled configuration by the tension spring mechanism, in particular to be self-unfoldable, and on the other hand by fastening the tension spring mechanism to mutually facing end sections of two adjacent stick segments, also in the disassembled configuration, if the stick is folded, for example.

In further particularly preferred embodiments of the invention, the at least one tensioning mechanism may comprise two compression springs which are adapted to pretension two adjacent stick segments axially towards one another, or comprise a tension spring which is adapted to axially pretension the two adjacent stick segments towards one another. Two compression springs or one tension spring for each tensioning mechanism can exert a significantly greater spring force than, for example, an elastic cable. This makes it possible for the stick segments to be designed to be self-unfoldable due to the higher tension spring forces and preferably to not have to be joined together by using the strength of the user. This in turn can significantly improve ease of use. Alternatively, it may also be possible for the tensioning mechanism to have only one compression spring, which may then preferably have a higher spring force in order to pretension the stick segments alone in the assembled configuration and which spring force is in particular high enough to allow adjusting the stick segments into the assembled configuration in a self-unfoldable manner. If, as described above, the tension element is designed as an elastic cable, it is also conceivable that the spring force may be provided by the elasticity of the cable and springs may be dispensed with entirely.

An extremely stable and reliable connection between two adjacent stick segments may be achieved if one end section of a stick segment is designed as a male or female coupling element and a complementary end section of an adjacent stick segment facing this end section is designed accordingly as a female or male coupling element.

In addition, the stick segments may be designed as hollow tubes and the end sections of the stick segments may be coupled to the hollow tubes. Such a configuration can ensure a particularly stable and reliable connection of the end sections of the stick segments and the intermediate sections of the stick segments arranged between them. The coupling of the end sections to the tubes may be implemented in a number of ways. In particular, but not by way of limitation, locking connections are thought of, for example, wherein locking projections may be provided on the end sections, which may engage with corresponding recesses in the tubes of the middle stick segment sections, or conversely locking projections may be provided on the tubes and corresponding recesses on the end sections. However, adhesive, screw, press connections, etc. may also be used. The tubes may in particular have an outer diameter of approximately 10 mm to 30 mm.

In order to save manufacturing costs and/or to facilitate assembly of the stick at the factory, the end sections may be formed in several parts, in particular in two parts.

In a particularly advantageous embodiment of the present invention, the stick may comprise three stick segments and two tensioning mechanisms. With common overall lengths of the stick in the assembled state of about 90 cm to about 150 cm, a three-part division of the stick having three stick segments results in an extremely user-friendly compact pack size of only about 30 cm to 50 cm.

Figure 2:
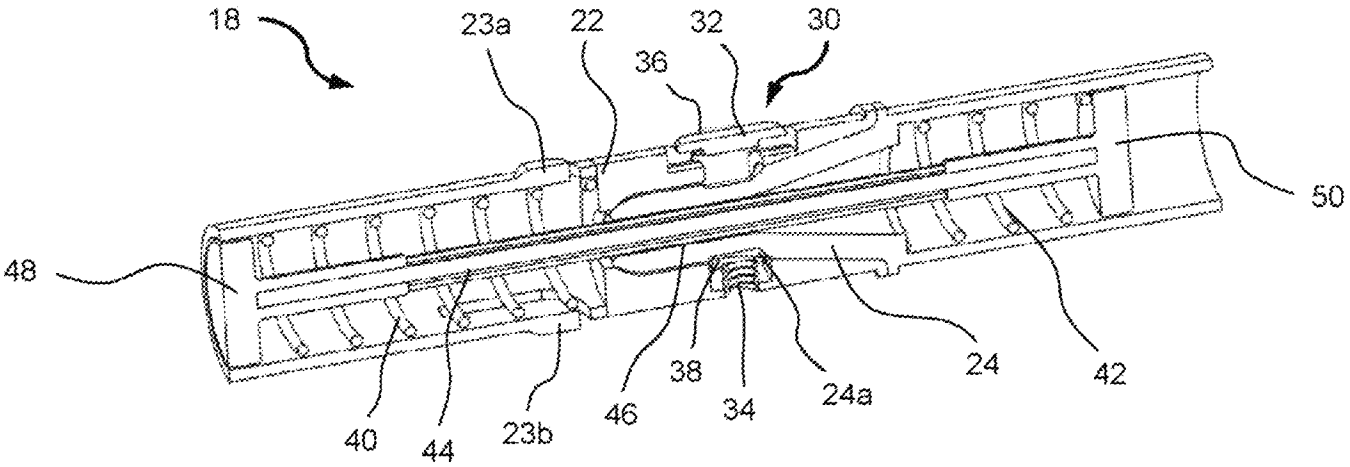
Figure 3:
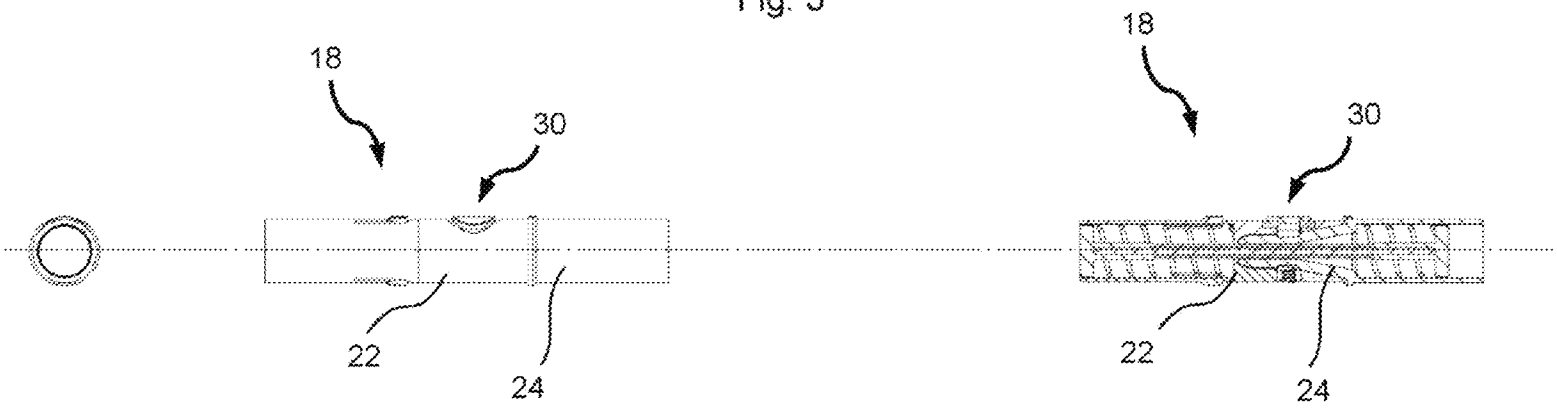
Figure 4:
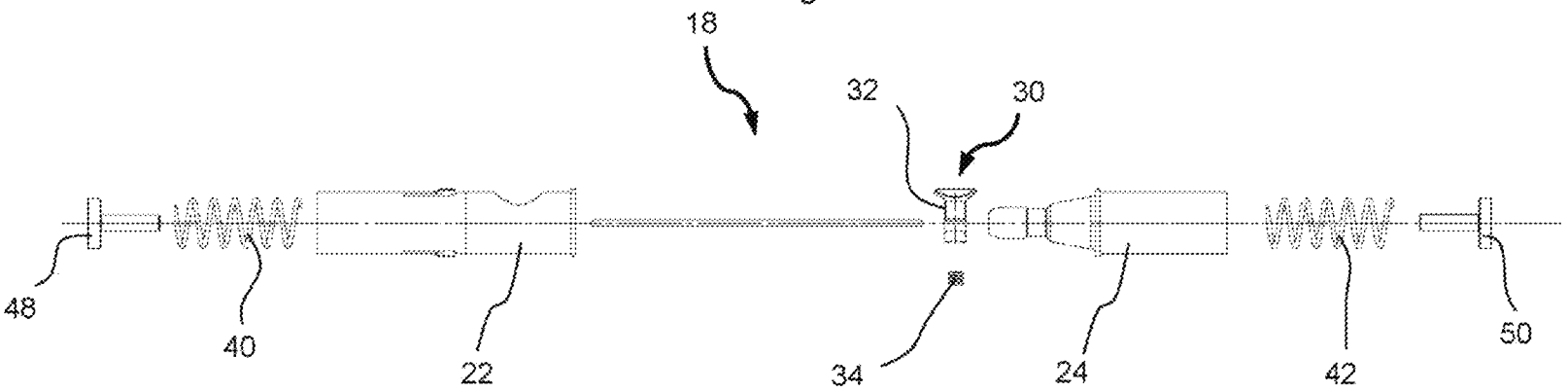
Figure 5:
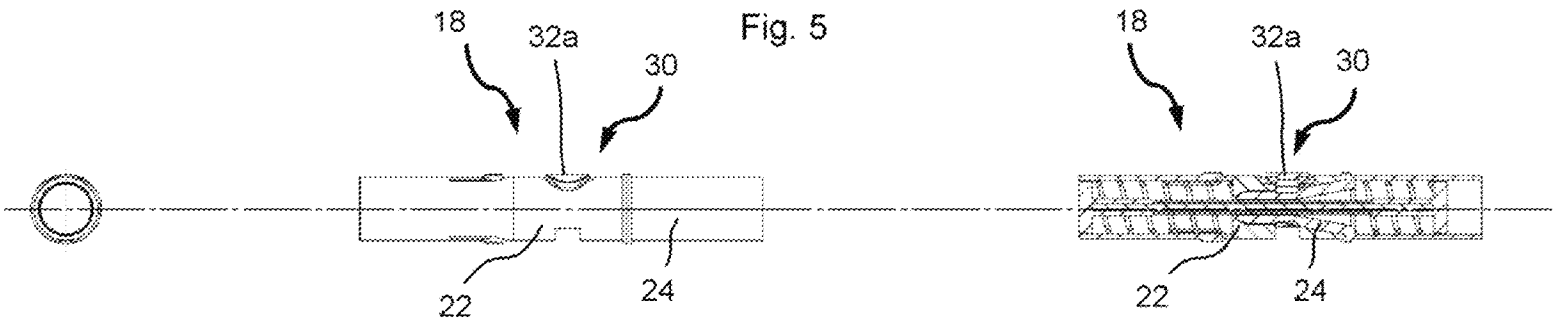
Figure 6:
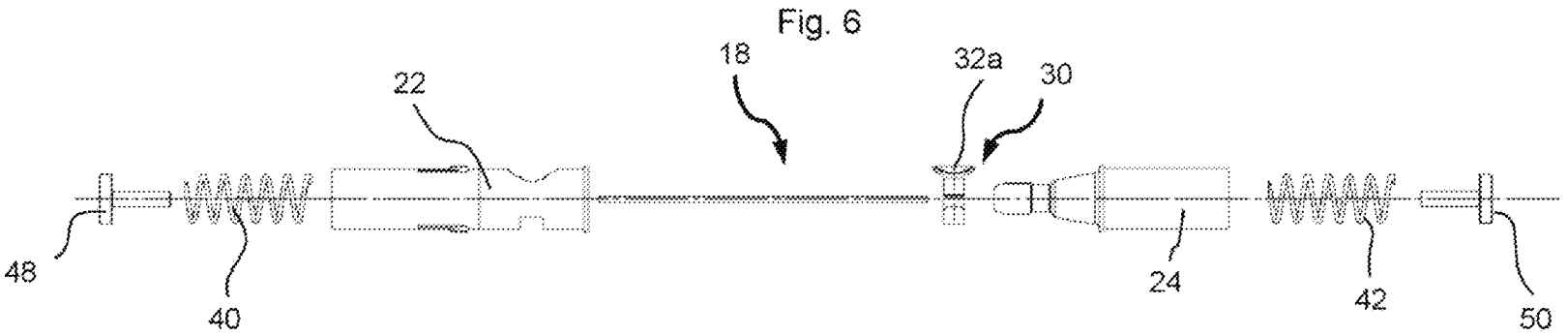
Figure 7:
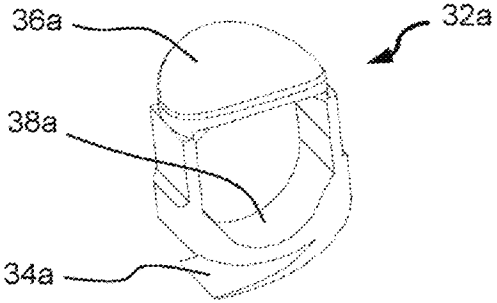
Figure 8:
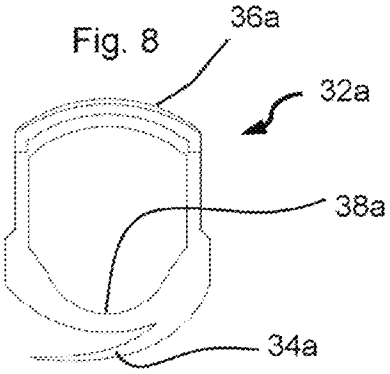
Figure 9:
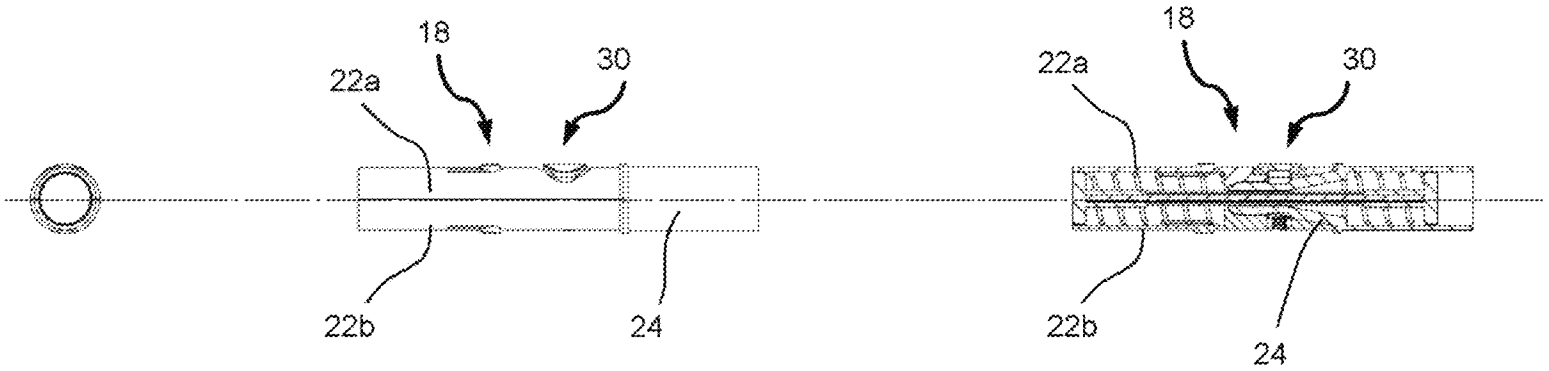
Figure 10:
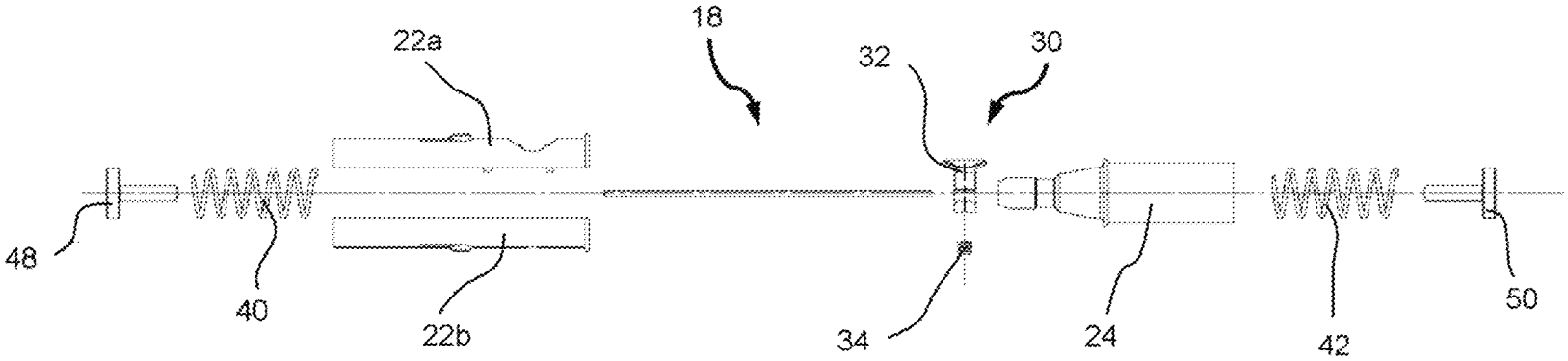
Figure 11:
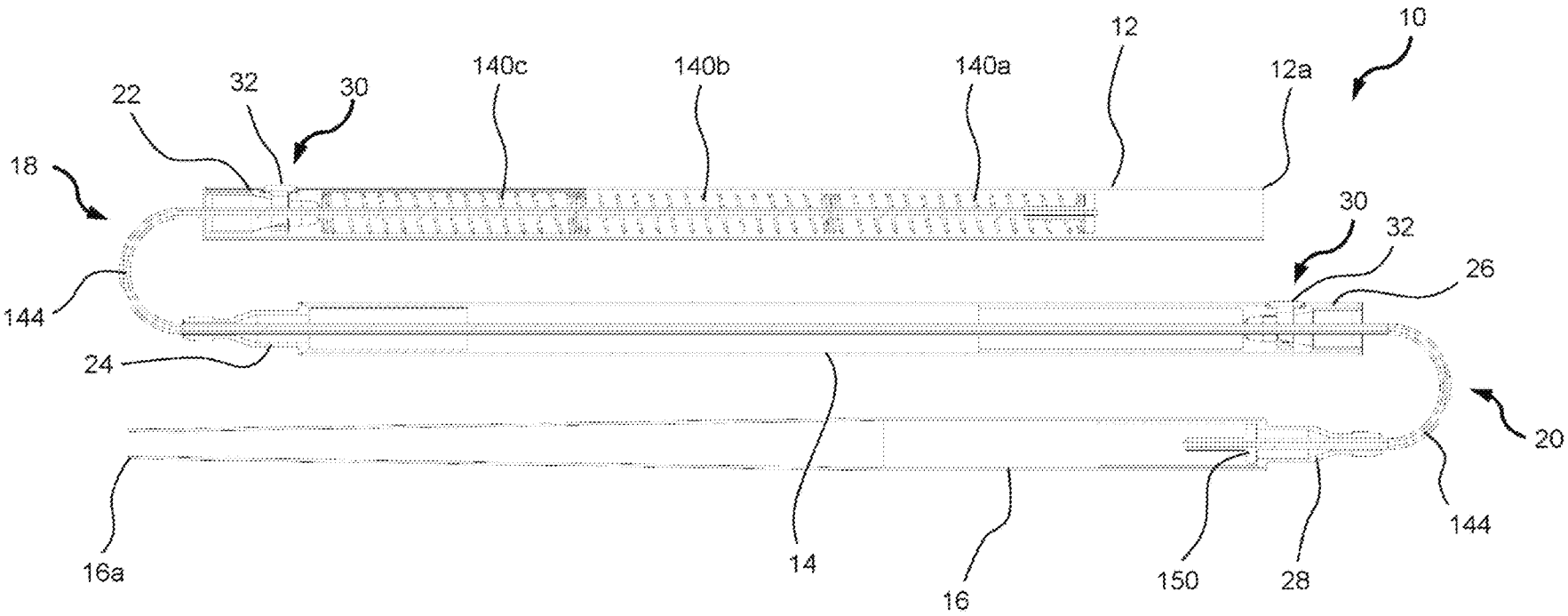

The invention is explained in more detail below on the basis of preferred exemplary embodiments with reference to the accompanying drawings. The figures show in detail:

FIG. 1 shows a foldable stick having three stick segments and two tensioning mechanisms in a disassembled configuration according to a first embodiment of the present invention, FIG. 2 shows a perspective sectional view of end sections of two stick segments and a tensioning mechanism of the stick shown in FIG. 1 in an assembled configuration, FIG. 3 shows a side view and a sectional view of the end sections of the two stick segments and the tensioning mechanism of the stick shown in FIG. 1 in an assembled configuration, FIG. 4 shows an exploded view of the end segments of the two stick segments and the tensioning mechanism of the stick shown in FIG. 1, FIG. 5 shows a perspective sectional view of end segments of two stick segments and a tensioning mechanism of a foldable stick in an assembled configuration according to a second embodiment of the present invention, FIG. 6 shows a side view and a sectional view of the end sections of the two stick segments and the tensioning mechanism of the stick shown in FIG. 5 in an assembled configuration, FIG. 7 shows a perspective view of an elastically flexible push button of a locking mechanism of the stick shown in FIG. 5, FIG. 8 shows a side view of the elastically flexible push button shown in FIG. 7, FIG. 9 shows a perspective sectional view of end segments of two stick segments and a tensioning mechanism of a foldable stick in an assembled configuration according to a second embodiment of the present invention, FIG. 10 shows a side view and a sectional view of the end segments of the two stick segments and the tensioning mechanism of the stick shown in FIG. 9 in an assembled configuration and FIG. 11 shows a perspective view of a foldable stick in a disassembled configuration according to a fourth embodiment of the present invention.

FIRST EMBODIMENT (FIGS. 1 TO 4)

A first embodiment of the present invention is described below with reference to FIGS. 1 to 4.

A foldable stick according to a first embodiment of the invention, shown in a disassembled configuration in FIG. 1 and generally designated with 10, comprises a plurality of stick segments 12, 14, 16 and at least one tensioning mechanism 18, 20. In particular, the stick 10 may comprise three stick segments 12, 14, 16, which may have essentially the same length, and two tensioning mechanisms 18, 20, as shown in FIG. 1. The stick 10 is adjustable between an assembled configuration in which all the stick segments 12, 14, 16 are joined axially aligned with one another and a disassembled configuration shown in FIG. 1 in which the stick segments 12, 14, 16 are detached from one another and can be folded together. The at least one tensioning mechanism 18, 20 may be provided between two stick segments 12 and 14, 14 and 16 on one end section 22, 26 of a stick segment 12, 14 and on a complementary end section 24, 28 of an adjacent stick segment 14, 16, respectively. The tensioning mechanism 18, 20 is adapted to pretension the stick segments 12, 14, 16 into the assembled configuration of the stick 10, in particular such that they self-unfold into the assembled configuration of the stick 10 without any external force being applied.

The stick 10 may further comprise a handle (not shown) at a handle-side upper end 12*a* on the uppermost stick segment 12 and may comprise a tip (not shown) on a tip-side bottom end 16*a* on the lowermost stick segment 16 opposite the handle-side end 12*a*. The lowermost stick segment 16 may be designed tapered in the direction of the tip. In addition, the stick segments 12, 14, 16 may preferably be designed as hollow tubes 12, 14, 16 and the end sections 22, 24, 26, 28 of the stick segments 12, 14, 16 may be coupled to the hollow tubes 12, 14, 16. For the coupling, as shown, for example, in FIGS. 2 to 4, locking connections may be used, wherein locking projections 23*a*, 23*b* may be provided on the end section 22, which may engage with corresponding recesses (not shown) in the tube 12. Conversely, locking projections may be provided on the tubes and corresponding recesses (not shown) at the end sections. Other coupling options, such as adhesive, screw, press connections, etc., may also be considered.

FIGS. 2 and 3 show the end sections 22, 24 of the two stick segments 12, 14 and the tensioning mechanism 18 of the stick 10 shown in FIG. 1 in an assembled configuration, FIG. 4 shows an exploded view thereof. Since the end sections 22 and 26 of the stick segments 12 and 14 and the end sections 24 and 28 of the stick segments 14 and 16 are of identical design, only one reference number each is given for better understanding and only the elements of the tensioning mechanism 18 are identified in the figures. The function of the tensioning mechanisms 18, 20 is also only described for the tensioning mechanism 18, but this functional description applies to the tensioning mechanism 20 in the same way.

The end section 22 may be designed as a female, in particular socket-shaped, coupling element 22 and the end section 24 facing the end section 22 may be designed as a male, in particular pin-shaped, coupling element 24. Alternatively, an inverted arrangement of female and male coupling elements is also possible. The tensioning mechanism 18 may have a locking mechanism 30, which may be provided in particular in the form of a push button 32 that is spring-loaded by a spring 34.

In the assembled configuration of the stick 10, the adjacent stick segments 12, 14 can be mutually locked and in particular axially, preferably axially and radially, blocked by the locking mechanism 30. This happens when an inner part 38 of the push button 32 engages with a recess 24*a* in the male coupling element 24 by pulling the male coupling element 24 into the female coupling element 22 by the spring force of the tensioning mechanism 18 and the inner part 38 of the push button 32 slides into the recess 24*a* in the male coupling element 24*a* via an inclined surface provided thereon. Upon actuation of an actuation region 36 of the push button 32 arranged on a side of the push button 32 opposite the spring 34 in the radial direction of the stick 10, the locking of the stick segments 12, 14 can be released by the inner part 38 of the push button 32 disengaging with the recess 24*a* in the male coupling element 24.

If the stick is to be provided in a self-unfoldable manner, it is particularly important that when the stick segments 12, 14 are locked, the spring force of the tensioning mechanism 18 is sufficient to overcome the total resistance of the connection arrangement of the two stick segments 12, 14, in order to be able to have the stick segments 12, 14 self-unfold without external force into the assembled configuration of the stick 10. The total resistance may be composed, among other things, of the resistance which arises when the stick segments 12, 14 are joined, in particular between the female coupling element 22 and the male coupling element 24, which resistance has to be overcome in order to compress the spring 34 so that the male coupling element 24 can slide over the inner part 38 of the push button 32 and the inner part 38 can snap into the recess 24*a* in the male coupling element 24.

This spring force may be achieved, for example, by having each tensioning mechanism 18 act as a tension spring mechanism, with a first end of the tension spring mechanism being fastened to an end segment of the stick segment 12 and a second end of the tension spring mechanism being fastened to a complementary end segment of the adjacent stick segment 14. In particular, the tensioning mechanism 18 may comprise two compression springs 40, 42, which act like a tension spring. Alternatively, a tension spring may be provided instead of the two compression springs 40, 42. This alternative is not shown in the accompanying drawings. The compression springs 40, 42 may be provided by a tension element 44 in the form of a cable 44, which runs in an axial guide channel 46 of the end sections 22, 24, and by a coupled stop 48 provided with a first end of the cable 44 in the interior of the stick segment 12, and a coupled stop 50 provided with a second end of the cable 44 in the interior of the stick segment 14 fastened to the stick segments 12, 14. The attachment may be realized, for example, by a clamp connection, an adhesive connection, etc. The cable 44 may preferably not be elastically flexible. In particular, a cable 44, 44*a* may be provided for each tensioning mechanism 18, 20, which extend essentially over the length of the tensioning mechanism 18, 20 and are not formed over the entire length of the stick 10, and are preferably shorter than the stick segments 12, 14, 16. The cables 44, 44*a* are provided in particular for the stick segments 12, 14, 16 to remain connected to one another even in the disassembled configuration.

In this embodiment of the invention, the compression spring 40 presses against an inner surface of the end section 22 or the female coupling element 22 and an inner surface of the stop 48, whereas the compression spring 42 presses against an inner surface of the end section 24 or the male coupling element 24 and an inner surface of the stop 50. As a result, the stick segments 12, 14 can be coupled to one another in particular in a self-unfoldable manner. The cable 44 can be relieved of load by the subsequent locking of both stick segments 12, 14 by the locking mechanism 30.

SECOND EMBODIMENT (FIGS. 5 TO 8)

A second embodiment of the present invention is described below with reference to FIGS. 5 to 8. Elements of the stick of the second embodiment which are equivalent to the stick of the first embodiment are also designated by the same reference numerals. As in the first embodiment, only the connection between the stick segments 12 and 14 is described again, since the connection between the stick segments 14 and 16 is constructed identically.

The stick of the second embodiment differs only from the stick 10 of the first embodiment in that instead of the spring 34, which in the first embodiment acts on the push button 32 with a spring force, in the second embodiment the push button 32*a*, which is shown in FIGS. 7 and 8, may itself be elastically flexible. As shown in FIGS. 5 to 8, this can be achieved by providing a resilient projection 34*a* on a side of the resilient push button 32*a* opposite to an actuation area 36*a* of the resilient push button 32*a*, which, as in the first embodiment, can press the spring 34 against the inner wall of the female coupling element 22 and thus can press the resilient push button 32*a* in the radial direction of the stick 10 to the outside. If the resilient push button 32*a* is pressed, an inner part 38*a* of the resilient push button 32*a* can disengage from the recess 24*a* in the male coupling element 24 and release the adjacent stick segments 12, 14 from the assembled configuration, as in the first embodiment.

Alternatively, several resilient projections may also be provided.

THIRD EMBODIMENT (FIGS. 9 AND 10)

A third embodiment of the present invention is described below with reference to FIGS. 9 and 10. Elements of the stick of the third embodiment, which are present in equivalent form in the stick of the first and the second embodiment, are also designated by the same reference numerals.

The stick of the third embodiment differs from the stick 10 of the first embodiment only in that the female coupling elements 22, 26 are formed in two parts. As in the first embodiment, only one female coupling element 22 is discussed. As shown in FIGS. 9 and 10, a parting plane of the two parts 22*a* and 22*b* of the female coupling element 22 runs along the stick axis.

It should be noted that the invention is not limited to the exemplary embodiments described above and that combinations of the three above-described embodiments are also possible, for example. Thus, a split or two-part end section as in the third embodiment and a resilient push button as in the second embodiment may also be combined with one another. It is also conceivable, as mentioned above in the description of the third embodiment, that instead of the female coupling element the male coupling element is split or two-part, or that both the female coupling element and the male coupling element are split or designed in two parts. Again, all combinations with the other embodiments are also conceivable, which for reasons of clarity are not to be detailed here, but are to be explicitly included in the scope of the invention.

FOURTH EMBODIMENT (FIG. 11)

A fourth embodiment of the present invention is described below with reference to FIG. 11. Elements of the stick of the fourth embodiment, which are equivalent to the stick of the first, second and third embodiment, are also designated by the same reference numerals.

The stick of the third embodiment differs from the stick 10 of the first, second and third embodiment in that merely one tension element 144 is provided in the form of a cable 144, in particular one that is not elastically flexible, which runs continuously through all the tensioning mechanisms 18, 20 of the stick 10.

The tension element 144 may pass through axial guide channels 46 of the end sections 22, 24, 26, 28. It may be coupled to a stop 148 at a first end of the tension element 144 inside the stick segment 12, coupled to a stop 150 at a second end of the tension element 144 inside the stick segment 16 and may run freely through the middle stick segment.

The tension element or cable 144 may preferably be not elastically flexible and in turn ensure that the stick segments 12, 14, 16 remain connected to one another even in the disassembled configuration.

The spring force for the tensioning mechanisms 18, 20 for aligning the stick segments 12, 14, 16 and for tensioning and/or unfolding the stick 10 may also be achieved by simply using an elastic element or, as in this embodiment, compression springs 140*a*, 140*b*, 140*c* connected in series, for example, are provided, which are preferably accommodated in only one stick segment—in this case the handle-side stick segment 12. Since springs connected in series act similarly to a single spring, any number of springs connected in series is possible, starting with just one spring.

Alternatively, the use of one or more tension springs connected in series is also conceivable. In this embodiment, the tensioning mechanisms 18 and 20 therefore act like a single tension spring mechanism.

In this embodiment, the series-connected compression springs 140*a*, 140*b*, 140*c* are arranged between the stop 148 and the end section 22 of the stick segment 12. An arrangement of the stick segment 16 between the stop 150 and the end section 28 would also be conceivable. The spring assembly consisting of the compression springs 140*a*, 140*b*, 140*c* can press against an inner surface of the end section 22 or of the female coupling element 22 and an inner surface of the stop 148. The stop 150 can press against an inner surface of the end section 28 or of the male coupling element 28. As a result, the stick segments 12, 14 can be coupled to one another in particular in a self-unfoldable manner.

The cable 144 can be relieved of load by the subsequent locking of both stick segments 12, 14 by means of locking mechanisms 30.

As in the previously described embodiments, locking mechanisms 30 may also be provided in the fourth embodiment. These locking mechanisms 30 may in particular be provided between all the stick segments 12, 14, 16 or on all the tensioning mechanisms 18, 20 and may advantageously be provided as spring-loaded push buttons 32. The push buttons 32 may be spring-loaded as in the first embodiment, or alternatively, may be designed to be resilient due to a resilient projection 34*a* as in the second embodiment.

As in the third embodiment, the female coupling elements 22, 26 may also be formed in two parts in the fourth embodiment.

The invention claimed is:

1. A foldable-stick, in particular a sports stick, comprising:

at least three stick segments, and at least two tensioning mechanisms, the foldable stick being adjustable between an assembled configuration in which all stick segments are joined aligned axially with one another, and a disassembled configuration in which the stick segments are detached from one another and can be folded together, characterized in that:

a tensioning mechanism is provided between two stick segments at an end section of a first stick segment of the two stick segments and at a complementary end section of an adjacent stick segment of the two stick segments such that the two stick segments are adjacent to each other and are non-overlapping in the assembled configuration, wherein:

the tensioning mechanism comprises a tension cable surrounded by a coil spring adapted to pretension the two stick segments into the assembled configuration of the foldable stick, the tensioning mechanism comprises a locking mechanism which is adapted in the assembled configuration to mutually block the two stick segments axially, preferably axially and radially, and the locking mechanism comprises a spring-loaded push button which is adapted to release the locking of the two stick segments when the spring-loaded push button is actuated, preferably in a radial direction, and which is axially offset from the coil spring.

2. The foldable stick according to claim 1, characterized in that the locking mechanism further comprises a spring which is coupled, in the assembled configuration, with the spring-loaded push.

3. The foldable stick according to claim 1, characterized in that each tensioning mechanism is adapted to pretension the stick segments into the assembled configuration of the foldable stick such that they self-unfold into the assembled configuration of the foldable stick without any external force.

4. The foldable stick according to claim 1, further comprising a handle, which is provided at a handle-side upper end of the foldable stick at an uppermost stick segment, and a tip, which is provided on a tip-side lower end of the foldable stick on a lowermost stick segment which is provided opposite to the handle-side upper end.

5. The foldable stick according to claim 4, characterized in that the lowermost stick segment is tapered in the direction of the tip.

6. The foldable stick according to claim 1, characterized in that, in the assembled configuration, the tensioning mechanism receives the end section of the first stick segment and the complementary end section of the adjacent stick segment.

7. The foldable stick according to claim 6, characterized in that, in the assembled configuration, the end section of the first stick segment comprises a recess that receives an inner part of the spring-loaded push button.

8. The foldable stick according to claim 1, characterized in that each stick segment of the stick segments has essentially the same length.

9. The foldable stick according to claim 1, characterized in that the end sections of the stick segments each have a continuous axial channel for guiding the tension cable and the tension cable runs through the guide channels of the end sections.

10. The foldable stick according to claim 1, characterized in that for each tensioning mechanism a cable is provided which extends substantially over the length of the tensioning mechanism and is not formed over the entire length of the foldable stick and is shorter than a stick segment.

11. The foldable stick according to claim 1, characterized in that each tensioning mechanism is essentially not elastically flexible.

12. The foldable stick according to claim 1, characterized in that each tensioning mechanism acts like a tension spring mechanism, a first end of the tension spring mechanism is fastened to an end section of a stick segment and a second end of the tension spring mechanism is fastened to a complementary end section of an adjacent stick segment.

13. The foldable stick according to claim 1, characterized in that the at least one tensioning mechanism comprises two compression springs which are adapted to pretension two adjacent stick segments axially towards each other, or comprises a tension spring which is adapted to pretension the two stick segments axially towards each other.

14. The foldable stick according to claim 1, characterized in that an end section of a stick segment is designed as a male or female coupling element and a complementary end section of an adjacent stick segment facing this end section is designed respectively as a female or male coupling element.

15. The foldable stick according to claim 1, characterized in that the stick segments are designed as hollow tubes and the end sections of the stick segments are coupled to the hollow tubes.

16. The foldable stick according to claim 1, characterized in that the end sections are constructed in several parts, in particular in two parts.

17. The foldable stick according to claim 1, characterized in that the stick consists of three stick segments and two tensioning mechanisms.

* * * * *